US007007777B2

(12) United States Patent
Gonser et al.

(10) Patent No.: US 7,007,777 B2
(45) Date of Patent: Mar. 7, 2006

(54) THREAD BRAKE AND TEXTILE MACHINES AND THREAD FEED DEVICES EQUIPPED THEREWITH

(75) Inventors: Roland Gonser, Albstadt (DE); Johannes Klaszka, Albstadt (DE)

(73) Assignee: SIPRA Patententwicklungs-und Beteiligungsgesell schaft mbH, Albstadt (DE)

( * ) Notice: Subject to any disclaimer, the term of this patent is extended or adjusted under 35 U.S.C. 154(b) by 0 days.

(21) Appl. No.: 10/939,261

(22) Filed: Sep. 10, 2004

(65) Prior Publication Data

US 2005/0067228 A1 Mar. 31, 2005

(30) Foreign Application Priority Data

Sep. 26, 2003 (DE) ..... 103 45 369

(51) Int. Cl.
*B65H 59/16* (2006.01)

(52) U.S. Cl. ..... 188/65.2; 188/65.5; 112/254; 242/150 R

(58) Field of Classification Search ..... 188/64, 188/65.1, 65.2, 65.3, 65.5, 73.1, 73.31, 206 R; 112/254; 242/419.4, 419.9, 150 R, 150 M
See application file for complete search history.

(56) References Cited

U.S. PATENT DOCUMENTS

| | | | | |
|---|---|---|---|---|
| 2,283,912 A | | 5/1942 | Bushey | 242/419.2 |
| 4,694,765 A | * | 9/1987 | Diehl | 112/254 |
| 4,901,942 A | | 2/1990 | Beitz et al. | 242/150 R |
| 5,070,745 A | * | 12/1991 | Lindsey et al. | 74/665 GB |
| 5,211,122 A | * | 5/1993 | Lin | 112/254 |
| 5,343,983 A | | 9/1994 | Horvath et al. | 188/65.1 |
| 5,782,424 A | | 7/1998 | Horvath et al. | 242/419.3 |
| 6,065,711 A | | 5/2000 | Plath | 242/419.4 |

FOREIGN PATENT DOCUMENTS

| | | |
|---|---|---|
| CH | 315852 | 10/1956 |
| CH | 357 008 | 10/1961 |
| DE | 913 148 | 7/1949 |
| DE | 35 04 739 A1 | 8/1986 |
| DE | 36 29 928 A1 | 3/1988 |
| DE | 41 04 663 C1 | 8/1992 |
| DE | 41 12 898 A1 | 10/1992 |
| DE | 43 01 507 A1 | 8/1994 |
| DE | 295 21 428 U1 | 4/1997 |
| DE | 197 20 795 A1 | 11/1998 |
| DE | 299 07 679 U1 | 10/2000 |
| GB | 629 319 | 9/1949 |

* cited by examiner

*Primary Examiner*—Melody M. Burch
(74) *Attorney, Agent, or Firm*—Michael J. Striker

(57) ABSTRACT

The invention relates to a thread brake with a holding means (17), a bearing pin (25), which has an assembly section (24) disposed in the holding means (17) and a bearing section (26) projecting out of the holding means (17), two brake elements (33, 34) displaceably disposed on the bearing section (26) and a pretensioning mechanism intended for adjustment of the braking force. The pretensioning mechanism includes a spring (29) pretensioning the assembly section (24), a tension element (39) attached to the bearing section (26) and an adjusting and protecting member (20), which is disposed to be axially displaceable in the holding means (17) and houses the assembly section (24) and the spring (29). The invention additionally relates to textile machines and thread feed devices equipped with such a thread brake (FIG. 3).

16 Claims, 3 Drawing Sheets

THREAD BRAKE AND TEXTILE MACHINES AND THREAD FEED DEVICES EQUIPPED THEREWITH

FIELD OF THE INVENTION

The invention relates to a thread brake with a holding means, a bearing pin, which has an axis, an assembly section disposed in the holding means and a bearing section located in axial direction next to said assembly section and projecting out of the holding means, a first brake element disposed to be axially displaceable on the bearing section and intended for abutment against the holding means, a second brake element disposed to be axially displaceable on the bearing section and intended for abutment against the first brake element, and a pretensioning mechanism, which is intended for adjustment of the braking force and which has a spring and a tension element attached to the bearing section. The invention also relates to a textile machine and a thread feed device with at least one such thread brake.

BACKGROUND OF THE INVENTION

Known thread brakes of this type are highly prone to soiling, since fluff and lint or residues of oil, paraffin or similar adhering to the threads easily accumulate on the thread contact surfaces or brake surfaces during operation. Therefore, it is known to rotatably dispose the brake elements on a bearing pin (DE 35 04 739 A1) or combine the bearing pin, the brake elements and the usual pretensioning mechanism intended for adjustment of the braking force to form one structural unit disposed to be freely rotatable as a unit in the holding means (DE 197 20 795 A1). The purpose of the rotatable mounting of the brake elements and/or the entire structural unit is to use the tangential forces exerted on the brake elements when the threads are moving to set the brake elements in rotation, and thus cause constant self-cleaning of the brake elements, in particular if their walls are provided preferably with adequately large openings.

In addition, thread brakes are known, in which the brake elements are coupled to a device that generates vibrations (DE 41 04 663 C1) such that a force action promoting the rotational movement of the brake elements results. However, such additional devices in machines, which use or process a large number of threads, are not acceptable from an economic viewpoint, since they involve enormous structural expense.

Apart from this, it has been found that, despite application of the above-described measures, fluff and lint adheres in particular to the pretensioning mechanisms for the brake elements. The pretensioning mechanisms are provided with helical pressure springs, and as a result thereof, the desired braking force can vary during operation of a circular knitting machine or similar, or at least a reproducible adjustment of the braking force can be made more difficult. This leads to frequent cleaning operations and thus to outage times of the machines. To avoid this disadvantage, protective caps are known (DE 41 12 898 A1), which are attached to the pretensioning mechanism and cover the helical pressure springs. However, such protective caps not only increase the structural expense, but also hinder access to the brake elements and their self-cleaning. Known thread brakes, in which the braking force is generated or released with gas pressure (DE 36 29 928 C2), are also associated with high expenditure.

Moreover, it is known (DE 43 01 507 C2, 295 21 428 U1) to adjust the braking force with the assistance of permanent magnets instead of helical pressure springs. The advantage of reduced capacity for dirt to accumulate on the pretensioning mechanisms is offset here by the disadvantage that the pretensioning force of the brake elements, and therefore the braking force exerted on the thread, is only variable by replacing magnetic inserts, which is associated with high time expenditure, and only in comparatively large steps, whereas the springs provided in conventional thread brakes allow continuous adjustment of the braking force. Therefore, the thread brakes used in practice, at least in circular knitting machines, contain pretensioning mechanisms, which are provided with open springs without protective covers, so that despite there being a tendency towards self-cleaning, they have to be cleaned in relatively short time intervals, and in a machine that processes or uses threads with a plurality of thread guides, e.g. a circular knitting machine with 96 systems or more, this necessitates expensive cleaning operations with corresponding machine outage times.

SUMMARY OF THE INVENTION

It is, therefore, an object of this invention to provide a thread brake of the kind specified above which reduces the risk of soiling.

A further object of this invention is to so design the thread brake mentioned above that it meets the requirements with respect to design and has the usual spring mechanism for adjustment of the braking force.

Yet another object of the invention is to provide a thread brake having the usual spring mechanism for adjustment of the braking force and which is so designed that the spring mechanism is housed at a location remote from the brake elements.

Further objects of the invention are to provide a textile machine and a thread feeding device being equipped with thread brakes with a reduced risk of soiling but still having a spring mechanism for adjustment of the braking force.

These and other objects are solved by the thread brake, the textile machine and the thread feed device, mentioned above and being characterized in accordance with this invention in that the assembly section is disposed to be axially displaceable in the holding means, the spring axially pretensions the assembly section and the pretensioning mechanism has an adjusting and protecting member, which is disposed to be axially displaceable in the holding means and houses the assembly section and the spring.

The invention has the advantage that the pretensioning mechanism provided with the usual spring and intended for adjustment of the braking force is associated with the assembly section of a bearing pin assembled in the holding means, and not with the bearing section carrying the brake elements. This enables the spring to be housed in an adjusting and protecting member, which, on the one hand, serves to mount the bearing pin on the holding means and to adjust the braking force and, on the other hand, substantially conceals the spring to the outside. In contrast, the brake elements are only subject to the action of a tension element, which is attached to the bearing section of the bearing pin and which, like the brake elements themselves, can be provided with smooth surfaces being little prone to soiling.

Further advantageous features of the invention may be seen from the sub-claims.

BRIEF DESCRIPTION OF THE DRAWINGS

The invention shall be explained in more detail below in association with the attached drawings of embodiments.

DETAILED DESCRIPTION OF A PREFERRED EMBODIMENT OF THE INVENTION

Figure 1:
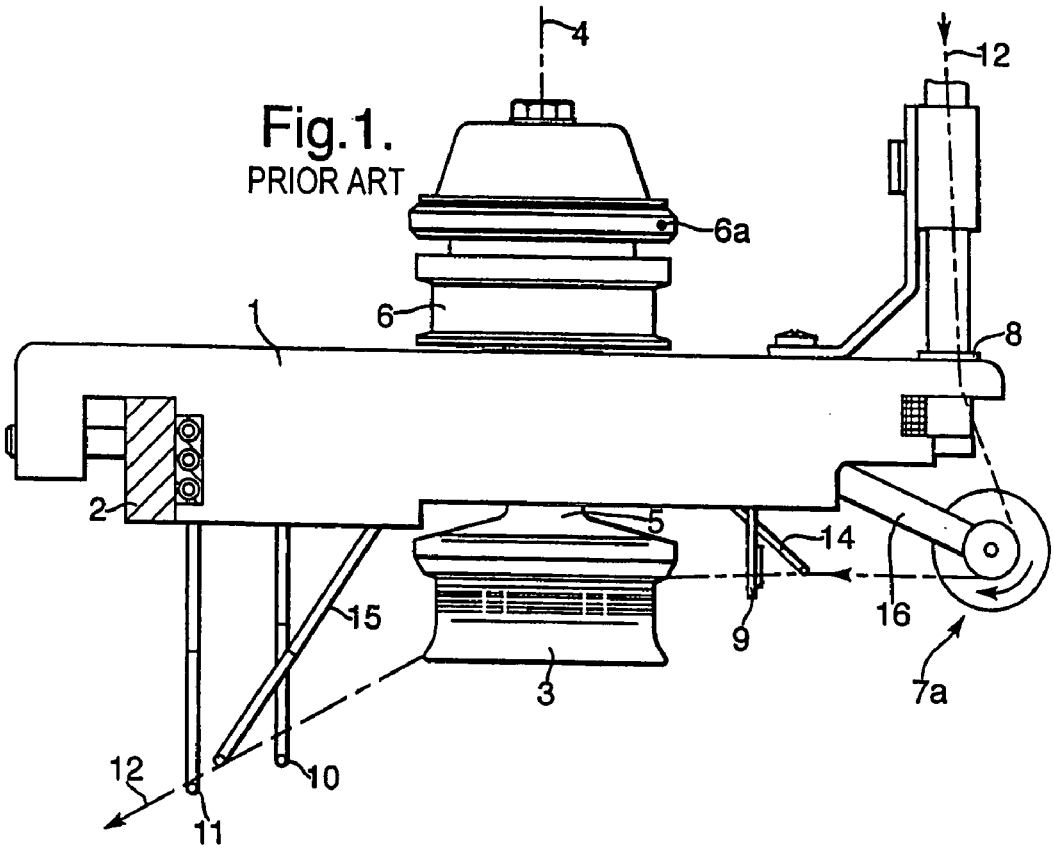
Fig.1. PRIOR ART
FIG. 1 is a schematic side view of a thread feed device with a thread brake.

The thread feed device shown in FIG. 1 has a support 1, which may be detachably fastened at its one end to an assembly rail 2 of a textile machine processing or using thread, e.g. a circular knitting machine. A usual storage or feed drum 3, which is disposed to rotate around a rotational axis 4 and for this purpose is connected firmly to a shaft 5 rotatably disposed in the support 1, is provided on the underside of the support 1. On a part of the shaft 5 that projects over the upper side of the holder 1, at least one pulley 6 is rotatably disposed, which is driven by a drive (not shown) by means of a belt or similar and can be connected for rotation with the shaft 5 by means of a manually switchable coupling 6*a*, for example, to thus drive the storage or feed drum 3.

A thread brake 7*a* and a thread feeder 8 located above brake 7*a* are fastened to the free end of the support 1. A thread feed guide element 9, e.g. an eyelet, arranged between the thread brake 7 and the feed drum 3 is arranged on the underside of the support 1 are provided, which, like the guide element 9, can consist of open or closed eyelets. A thread 12 is directed from a storage bobbin (not shown) through the thread feeder 8, the thread brake 7*a* and the guide element 9 obliquely upwards and essentially tangentially onto the thread surface of the feed drum 3, is wound on this in at least one, preferably several windings and finally unwound tangentially and fed through the two guide elements 10 and 11 to a processing point (not shown) of a knitting machine or similar. Feelers 14 and 15, which are also attached to the support 1, can serve to monitor the thread 12 in the usual manner.

Thread feed devices of this type are generally known to the person skilled in the art (e.g. DE 197 20 795 A1) and therefore do not need to be explained in more detail.

Figure 2:
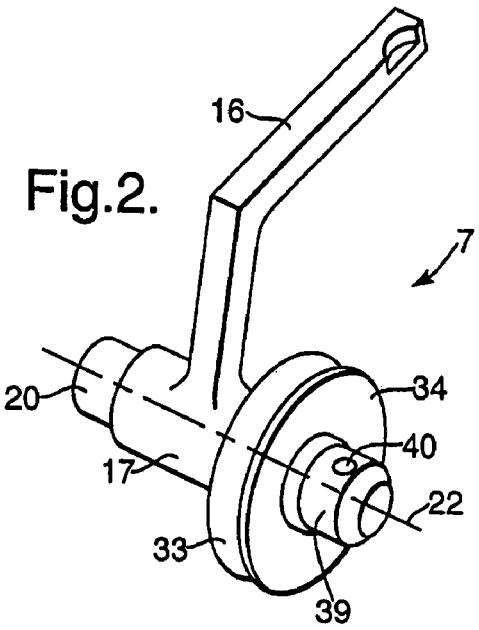
FIG. 2 is a schematic perspective view of a thread brake according to the invention.
Figure 3:
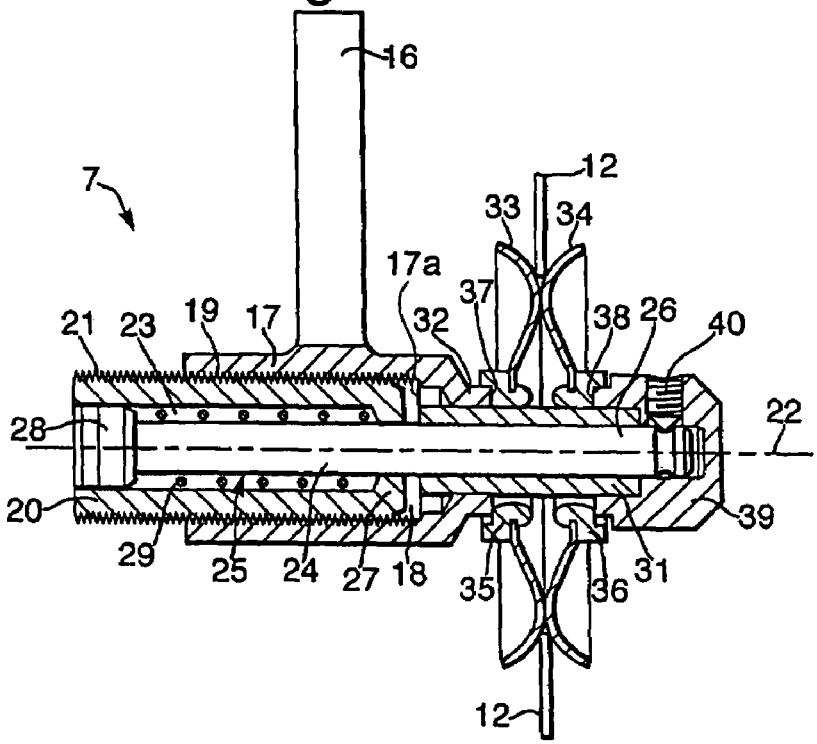
FIGS. 3 and 4 each show a view in longitudinal section through the thread brake according to FIG. 2 each in a mode respectively with low and high braking force.
Figure 4:
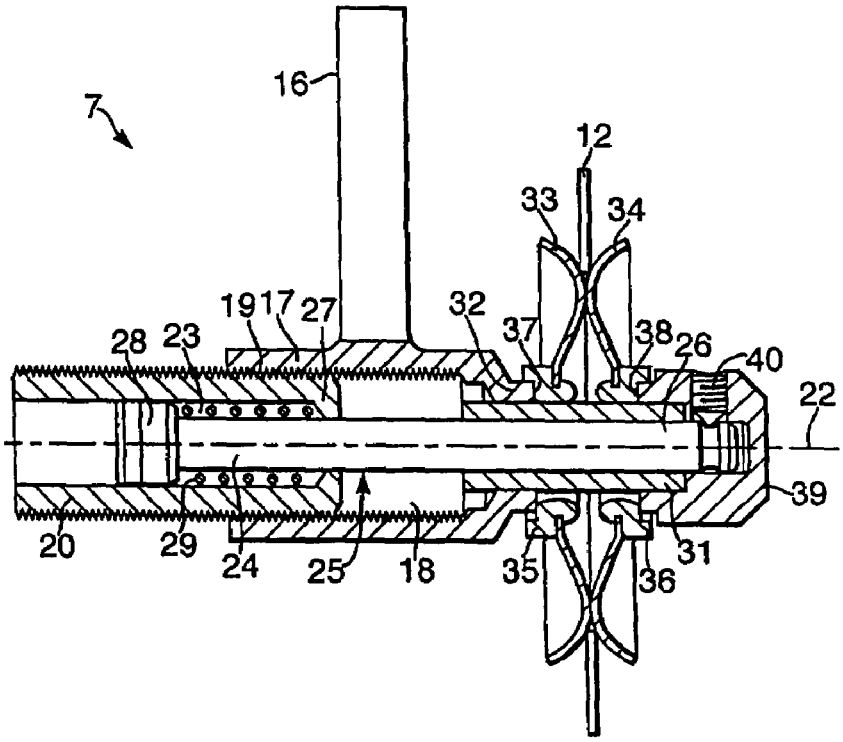

Details of a first embodiment of the thread brake according to the invention may be seen from FIGS. 2 to 4. According to these, thread brake 7 has a holding element 16 in the form of an angled piece or similar, which can be fastened to the support according to FIG. 1 or similar in a manner not shown. The holding element 16 supports a holding means 17 with a cylindrical seat 18, which is provided with an internal thread 19. An adjusting and protecting member 20, in the form of a hollow cylindrical or sheath-type member in the embodiment, which is provided with an external thread 21 on its shell that fits into the internal thread 19 of the holding means 17, is disposed in the seat 18. Therefore, the adjusting and protecting member 20 can be screwed into the seat 18 and moved back and forth in this by axially rotating back and forth, i.e. parallel to a longitudinal axis 22 of the holding means 17.

An assembly section 24 of a bearing pin given the general reference 25 is arranged in an inner cavity 23 of the adjusting and protecting member 20, which is coaxial to the longitudinal axis 22 and open to the outside, i.e. to the left in FIGS. 3 and 4. The assembly section 24 has an outside cross-section, which is smaller than the inside cross-section of the cavity 23, and is coaxially connected to a bearing section 26 of the bearing pin 25 on a side projecting out of the adjusting and protecting member 20, on the right in FIGS. 3 and 4. To permit a relative movement that is substantially tilt-free between the bearing pin 25 and the adjusting and protecting member 20 parallel to the longitudinal axis 22, on a side facing the bearing section 26, the right side in FIGS. 3 and 4, the adjusting and protecting member 20 has an end wall 27, which has a coaxial bearing opening for the assembly section 24, the inside diameter of which is only slightly larger than the outside diameter of the assembly section 24 and which thus forms a radially inward projecting shoulder extending around in a ring shape. On the other hand, on a side remote from the bearing section 26, the left side in FIGS. 3 and 4, the assembly section 24 has a preferably ring-shaped projection 28 extending radially outwards, which is provided with an outside cross-section corresponding essentially to the inside cross-section of the cavity 23, which preferably has the same cross-section throughout in the direction of the longitudinal axis 22. The assembly section 24 is therefore disposed in the adjusting and protecting member 20 to slide in the direction of the longitudinal axis 22 by means of the end wall or shoulder 27 and the projection 28. In the embodiment, the projection 28 is configured in the form of a bead moulded onto the assembly section 24.

The assembly section 24, and with it the entire bearing pin 25, are pretensioned by a spring 29, configured in the embodiment as a helical pressure spring, in the direction of the longitudinal axis 22 and in the direction of a side opposed to the bearing section 26. For this, the spring 29 is slipped coaxially onto the assembly section 24, arranged in the part of the cavity 18 remaining between said assembly section and the wall of the adjusting and protecting member 20, and at its ends supported between the projection 28 and the shoulder 27 or another shoulder of the adjusting and projecting member 20 in such a way that it endeavours to press the bearing pin 25 to the left in FIGS. 3 and 4. The pretensioning force in this case is dependent on the axial position of the adjusting and protecting member 20 and on whether member 20 is screwed comparatively deeply into the seat 18 (FIG. 3), which corresponds to a low pretensioning force, or is screwed comparatively far out of the seat 18 (FIG. 4), which results in a high pretensioning force. A scale interacting with a marking (not shown) on the holding means 17 can be provided on the outer shell of the adjusting and protecting member 20 for the reproducible adjustment of the pretensioning force.

In the embodiment, a preferably cylindrical bearing bush 31 is slipped onto the preferably cylindrical bearing section 26, which axially adjoins the assembly section 24 of the bearing pin 25, said bearing bush 31 preferably being made of a wear-resistant material having a low coefficient of friction such as a ceramic or plastic, for example. The bearing bush 31 has an inside diameter, which is slightly larger than the outside diameter of the bearing section 26. Moreover, on a side facing the bearing section 26, the holding means 17 is expediently provided with a preferably cylindrical bearing ring 32 for the bearing bush 31, the inside diameter of said ring being slightly larger than the outside diameter of the bearing bush 31. In this case, the bearing bush 31 is preferably arranged to be easily rotatable both on the bearing section 26 and in the bearing ring 32 by a suitable loose fit of a few tenths of a millimeter. The bearing bush 31 can also be arranged to move on the bearing section 26 in the axial direction. Further, bearing bush 31 preferably extends only as far as a shoulder 17*a*, which projects into the seat 18 of the holding means and which at the same time serves as a stop for the adjusting and protecting member 20 in the position where it is screwed to the maximum into the seat 18.

A first brake element 33 and a second brake element 34 of the thread brake according to the invention are disposed on a part of the bearing bush 31, through which the bearing section 26 projects, located outside the holding means 17, i.e. on the right of the means 17 in FIGS. 3 and 4. The two brake elements 33, 34 have an essentially circular outside cross-section and are each provided with a hub 35, 36 in their centre, which is preferably disposed on the bearing bush 31 with little play for being rotable and axially displaceable on the bearing bush 31. In this case, the hub 35 of the first brake element 33 facing the holding means 17 has a slide face 37, which is located axially on the inside and lies against an end face of the bearing ring 32 when the thread brake 7 is in an assembled state. In contrast, the hub 36 of the second brake element 34 is axially spaced from the hub 35 and is provided with a slide face 38, which points axially outwards, i.e. to the right in FIGS. 3 and 4, and against which a tension element 39 lies in the assembled state. In the embodiment, this tension element 39 is a structural part, which, on the one hand, increases the cross-section of the bearing section 26 and, on the other hand, is configured as a sealing cap, which is attached onto the end of the bearing section 26 remote from the assembly section 24 and is preferably detachably connected thereto by a headless screw 40 or similar. This enables the bearing pin 25 to be inserted from the side of the holding means 17 firstly through the seat 18, and possibly the adjusting and protecting member 20 screwed in this, and through the bearing ring 32 into the thread brake, and enables the bearing bush 31 and the brake elements 33, 34 then to be assembled from the opposite side, and subsequently the tension element 39 to be fastened on a part of the bearing section 26 projecting out of the bearing bush 31.

As a result of the described pretensioning of the bearing pin 25 through the spring 29, to the left in FIGS. 3 and 4, the tension element 39 is likewise pretensioned to the left, so that it lies with an end slide face against the slide face 38 of the hub 36 of the second brake element 34, and therefore presses this with a force, which is dependent on the axial adjustment of the adjusting and protecting member 20, axially against the first brake element 33, which in turn abuts against the bearing ring 32 of the holding means 17 with its slide face 37. The braking force exerted by the brake elements 33, 34 onto the thread 12 guided between them, shown schematically in FIGS. 3 and 4, can be adjusted in the limits shown in FIGS. 3 and 4, for example, as a result of the rotation of the adjusting and protecting member 20 and its axial displacement caused as a result of this.

During the operation of a textile machine using or processing thread 12, the thread 12 exerts a torque onto the brake elements 33, 34. Depending on the diameters of the brake elements 33 and 34, the outside diameter of the bearing bush 31, the sizes of the slide faces 37 and 38 and also the sizes and diameters of the faces on the bearing ring 32 and the tension element 39 interacting with these, the brake elements 33, 34 are additionally set in rotation to conduct a self-cleaning operation in a manner known per se. A particular advantage of the invention results from the circumstance that the brake elements 33 and 34, the holding means 17 with the bearing ring 32 and also the tension element 39 can all be provided with smooth surfaces, which are not prone to soiling through fluff, dust or similar, as shown in particular in FIG. 2, and that, moreover, the size of the interacting friction surfaces as well as the size of the gaps remaining between the individual parts can be optimised in such a way that fluff and dust or similar is substantially prevented from penetrating into the interior of the thread brake 7. This applies even if, during operation, only one of the two brake elements 33, 34 rotates alone around the bearing bush 31 or together with this around the bearing section 26 of the bearing pin 25 that is generally not rotated along with it.

A particularly significant advantage of the described thread brake is ultimately that the spring 29 used for adjustment of the braking force is arranged outside the region of the brake elements 33, 34 and is almost completely concealed by the adjusting and protecting member 20 as well as the projection 28 to the outside. As a result, the penetration of dust and dirt into the areas between the individual windings of the spring 29 is extremely unlikely, and therefore once adjusted, the braking force remains unchanged over and beyond long service periods. Moreover, the braking force can be adjusted in a simply reproducible manner. Finally, access to the brake elements 33, 34 is not hindered in any way, which also assists any possible self-cleaning.

Figure 5:
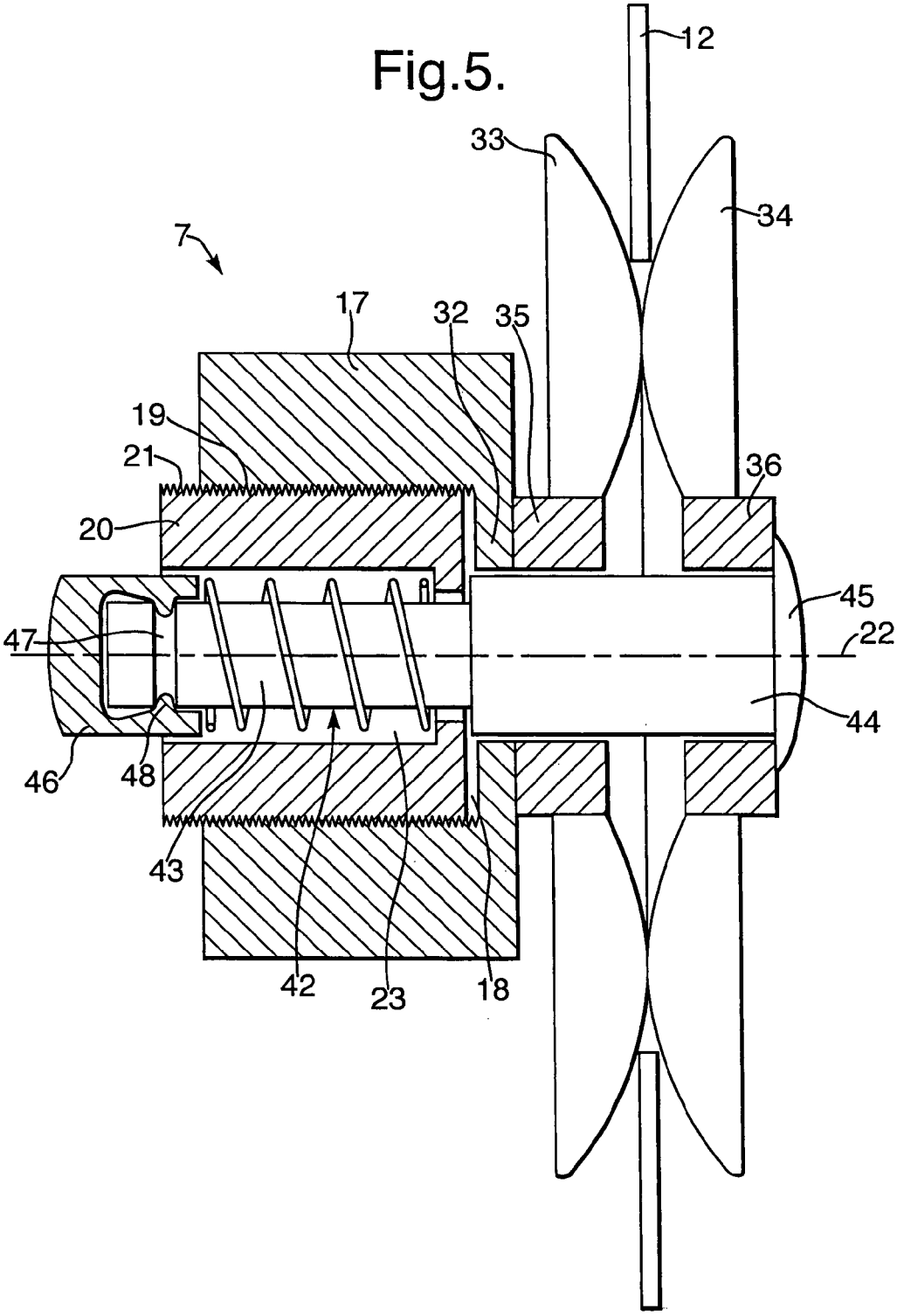
FIG. 5 is a view in longitudinal section corresponding to FIG. 3 on a further enlarged scale through a second embodiment of a thread brake according to the invention in a mode with low braking force.

The embodiment according to FIG. 5 which is deemed to be the best one up to now, differs from that according to FIGS. 2 to 4 essentially only in that the bearing bush 31 has been omitted and another bearing pin 42 is provided. Therefore, identical parts are provided with the same reference numerals.

In contrast to FIGS. 2 to 4, an assembly section 43 of the bearing pin 42 being arranged in the adjusting and protecting member 20 has a smaller outside diameter than a bearing section 44 of the bearing pin 42 projecting out of the holding means 17 and expediently disposed in the bearing ring 32. Moreover, the hubs 35, 36 of the brake elements 33, 34 are disposed directly, and preferably rotably, on the bearing section 44, wherein the same applies here with respect to the optimisation of the interacting slide or friction faces and the easy axial displaceability of the brake elements 33, 34 as described for the embodiment according to FIGS. 2 to 4.

In the embodiment according to FIG. 5, the structural part forming a tension part 45, which is intended for abutment against the second brake element 34 and increases the cross-section of the bearing section 44, is moulded onto the end of the bearing section 44 remote from the assembly section 43 and is produced in one piece with this, for example. In contrast, at the opposite end of the bearing pin 42 a projection 46 intended for support of the spring 29 and for sliding mounting of the assembly section 43 is configured as a sealing cap detachably placed onto the free end of the assembly section 43. This sealing cap is fastened, for example, by an annular groove 47 provided in the assembly section 43 and an annular bead 48 latching into this and projecting radially inwards from the sealing cap. Assembly therefore occurs from the right in this embodiment, in that the bearing pin 42 is firstly pushed through the hubs 35 and 36, the bearing ring 32 and the adjusting and projecting member 20, then the spring 29 is inserted from the left and finally the sealing cap 46 is pressed onto the assembly section 43.

Otherwise, the configuration and function of the embodiment according to FIG. 5 correspond to those of the embodiment according to FIGS. 2 to 4. In this case, the tension element 45, the bearing pin 42, the adjusting and protecting member 20, the spring 29 and the projection 46 likewise have a pretensioning mechanism intended for adjustment of the braking force of the thread brake.

The invention is not restricted to the described embodiments, which can be modified in a variety of ways. For example, the bearing bush 31 could be firmly connected to the assembly section 26 or also firmly connected to the holding means 17. Moreover, the brake elements 33, 34 could be arranged to be non-rotatable on the bearing bush 31 or the assembly section 44, if self-cleaning can or should be omitted. Moreover, the bearing pin could be configured in two parts, in particular in the case of FIG. 5 and have a bearing section 44 that is subsequently firmly connected to the assembly section 43, in which case different cross-sectional forms to those shown are also possible. In addition, it would be possible to arrange the adjusting and protecting member 20 to be axially displaceable but non-rotatable in the seat 18 of the holding means 17, and to provide it, for example, with an associated fastening screw to fix a desired axial position. The spring 29 could also have a different configuration to that shown. Moreover, it is obvious that the thread brake 7 according to the invention, in contrast to FIG. 1, can also be used independently of a thread guide device and can be fastened directly on a textile machine, for example, by means of holding elements 16. Finally, it should be understood that the different features can be used in different combinations to those shown and described.

It will be understood, that each of the elements described above or two or more together, may also find a useful application in other types of construction differing from the types described above.

While the invention has been illustrated and described as embodied in a circular knitting machine, it is not intended to be limited to the details shown, since various modifications and structural changes may be made without departing in any way from the spirit of the present invention.

Without further analysis, the forgoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. Thread brake, comprising: a holding means (17) for mounting the brake to a support (1), said holding means (17) having a receptacle (18) and a longitudinal axis (22) and having a bearing ring (32); an adjusting and protecting member (20) having an inner cavity (23) and being displaceably mounted in said receptacle (18) parallel to said axis (22) in an assembled state of the thread brake; a bearing pin (25, 42) having an assembly section (24, 43) being displaceably mounted in said cavity (23) parallel to said axis (22), and a bearing section (26, 44) being axially located adjacent with said assembly section, projecting out of said holding means (17) and being provided with a tension element (39, 45) at a side remote from said assembly section (24, 43), a first and a second brake element (33, 34) being axially displaceably mounted on said projecting bearing section (26, 44), wherein said first brake element for consistency in terminology (33) is intended for abutment against said holding means (17) via a first hub (35) having a slide face (37), wherein in said assembled state an end face of the bearing ring (32) contacts said first hub (35) and lies directly against said slide face (37) (17), whereas said second brake element (34) is mounted between said first brake element (33) and said tension element (39, 45); and a pretensioning mechanism being intended for adjustment of a braking force, said mechanism including said adjusting and protecting member (20), said tension element (39, 45) and a spring (29) being mounted in said cavity (23) and axially pretensioning said assembly section (24, 43) such that said tension element (39, 45) presses said second brake element (34) against said first brake element (33) and said first brake element (33) against said holding element (17).

2. Thread brake according to claim 1, wherein said adjusting and protecting member (20) is configured as a sleeve, which on a side facing said bearing section (26, 44) has an end wall (27), and wherein said assembly section (24, 43) projects through said end wall (27).

3. Thread brake according to claim 2, wherein said end wall (27) has a bearing opening with an inside cross-section, which corresponds essentially to an outside cross-section of said assembly section (24, 43).

4. Thread brake according to claim 3, wherein said tension element (39, 45) is configured as a structural part, which increases the cross-section of said bearing section (26, 44) and is intended for abutment against said second brake element (34).

5. Thread brake according to claim 1, wherein said first brake element (33) is disposed on said bearing section via said first hub (35) and said second brake element (34) is disposed on said bearing section (44) via a second hub (36).

6. Thread brake according to claim 5, wherein said tension element (45) is moulded onto an end of said bearing section (44) axially remote from said assembly section (43).

7. Thread brake according to claim 1, wherein said first and said second brake elements (33, 34) are disposed on a bearing bush (31), and wherein said bearing section (26) projects through said bearing bush (31).

8. Thread brake according to claim 7, wherein said tension element (39) is configured as a sealing cap being detachably fastened to an end of said bearing section (26) axially remote from said assembly section (24).

9. Thread brake according to claim 7, wherein on a side facing said bearing section (28), said holding means (17) has said bearing ring (32) for mounting said bearing bush (31) in an axially displaceable and rotatable manner.

10. Thread brake according to claim 1, wherein said assembly section (24, 43) has a radial projection (28, 46) on an end axially remote from said bearing section (26, 44), and wherein said spring (29) is a helical pressure spring being slipped onto said assembly section (24, 43), said spring (29) further being supported between said projection (28, 46) and a shoulder (27), which is provided on a side of said adjusting and protecting member (20) axially remote from said projection (28, 46).

11. Thread brake according to claim 10, wherein said projection (28,46) is configured; in a ring shape and provided with an outside cross-section, which essentially corresponds to an inside cross-section of said cavity (23).

12. Thread brake according to claim 10, wherein said projection (28) is formed by a bead moulded onto said assembly section (24).

13. Thread brake according to claim 10, wherein said projection (46) is formed by a sealing cap (46) detachably connected to said assembly section (43).

14. Thread brake according to claim 1, wherein said holding means (17) has a cylindrical seat (18) provided with an internal thread (19), and wherein said adjusting and protecting member (20) is configured as a sleeve provided with an external thread (21) fitting into said internal thread (19).

15. Textile machine with at least one thread brake (7), wherein said thread brake (7) is configured according to claim 1.

16. Thread feed device with at least one thread brake (7) for a textile machine, wherein said thread brake (7) is configured according to claim 1.

* * * * *